United States Patent [19]

Sakaki

[11] Patent Number: 4,900,606

[45] Date of Patent: Feb. 13, 1990

[54] RUNNER FOR COVERING A CARPET

[75] Inventor: Katsunori Sakaki, Nara, Japan

[73] Assignee: Eidaikako Kabushiki Kaisha, Osaka, Japan

[21] Appl. No.: 258,900

[22] Filed: Oct. 17, 1988

[30] Foreign Application Priority Data

Jul. 11, 1988 [JP] Japan ..... 63-92247[U]

[51] Int. Cl.[4] ..... B32B 5/14

[52] U.S. Cl. ..... 428/99; 428/157; 428/120; 428/213; 428/218; 428/192

[58] Field of Search ..... 428/99, 120, 192, 218, 428/170, 156, 213, 157; 16/4

[56] References Cited

U.S. PATENT DOCUMENTS 3,158,893 12/1964 Smith ..... 16/4

3,559,231 10/1968 Hill ..... 428/167

*Primary Examiner*—Alexander S. Thomas

[57] ABSTRACT

A carpet runner for temporarily covering a carpet to prevent it from becoming soiled or wet, the carpet runner comprising a walking zone in the center having a rugged face on the top surface and spikes on the bottom surface; and edge zones at either side of the walking zone, wherein the edge zones are heavier than the walking zone.

11 Claims, 3 Drawing Sheets

RUNNER FOR COVERING A CARPET

BACKGROUND AND SUMMARY

The present invention relates to a runner for covering a carpet against becoming soiled and/or wet, and more particularly, to a runner for temporary use at hotels, theaters, or houses so as to prevent the carpets from being spoiled with muddy footprints on rainy days. Hereinafter the runner is called the carpet runner or merely the runner.

Generally speaking, carpets are difficult to launder when they become soiled. On rainy days walkers' shoes bring mud onto the carpet, and the mud stays in between the piles of the carpet. To prevent the carpets from becoming soiled or wet, the common practise is to cover them with runners. A typical example of the known runners is illustrated in FIG. 6, which will be described in detail:

A runner is normally stored in a roll. When in need, it is unrolled and placed on a carpet (A). The runner is generally made of soft plastics, and narrower in width than the carpet (A). The illustrated runner has edge zones 42 at opposite sides and a walking zone 41 in the center. The walking zone 41 is provided with a rugged face 1*a* on top, and spikes 1*b* on the bottom. The rugged face 1*a* is designed to prevent the walkers from slipping on the wet runner, and the spikes 1*b* are designed to secure the runner to the carpet (A).

The problems of the known runner are that when the carpet (A) has high piles, the walking zone 41 sinks deep in the piles, and warps as a whole with the edge zones 42 rising above the carpet (A). Another problem is that when the runner is unrolled, the edge zones 42 become wavy, which results from the rolled state in stock. The walkers on the carpet (A) are in danger of stumbling over the rising, wavy edge zones 42. What is worse, the appearance of the carpet is spoiled by the rising, wavy edge zones of the runner.

The present invention is directed to a carpet runner which solves the problems encountered by the known carpet runners, and has for its object to provide a carpet runner placeable flat on a carpet without projecting any obstacle for the walkers thereon.

Other objects and advantages of the present invention will become more apparent from the following detailed description, when taken in conjunction with the accompanying drawings which show, for the purpose of illustration only, one embodiment in accordance with the present invention.

According to the present invention there is provided a carpet runner for temporarily covering a carpet to prevent it from becoming soiled, the carpet runner including a walking zone in the center, and edge zones at either side of the walking zone, wherein the edge zones are heavier than the walking zone.

DETAILED DESCRIPTION OF THE PREFERRED EMBODIMENT

Figure 1:
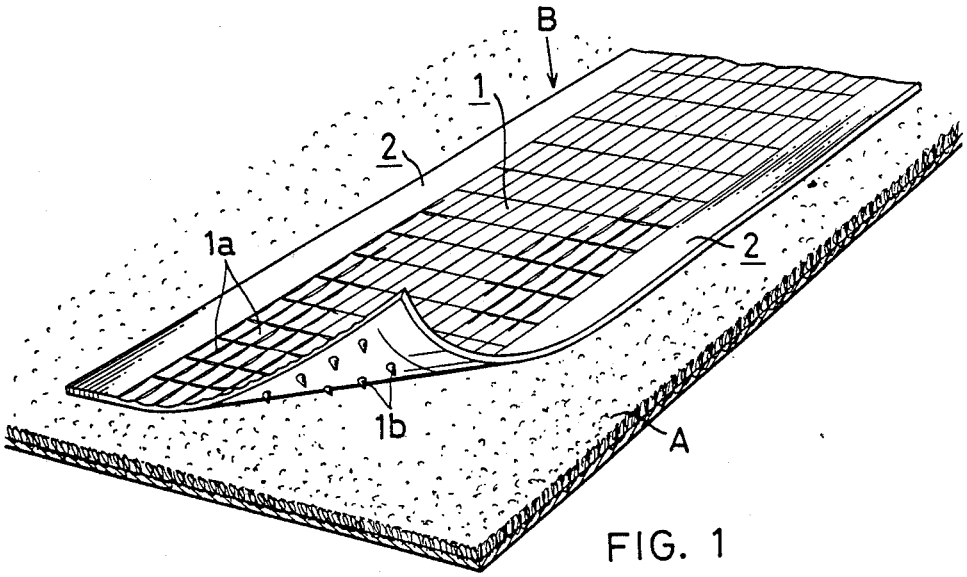
FIG. 1 is a perspective view showing a carpet runner according to the present invention.

Referring to FIG. 1 there are provided a carpet (A) and a runner (B) placed on the carpet (A). The runner (B) includes a walking zone 1 in the center, and edge zones 2 at either side of the walking zone 1. The size of the runner (B) can be various depending upon that of the carpet (A). A preferred embodiment has a thickness of 0.5 to 1.5 mm, and a width of 600 to 1200 mm.

The walking zone 1 is provided with a rugged face 1*a* on top, and spikes 1*b* on the bottom. The rugged face 1*a* is designed to protect the walkers on the carpet from slipping thereon, and the spikes 1*b* are designed to secure the runner (B) to the carpet (A). The walking zone 1 is preferably made of soft plastic such as polyvinyl chloride.

The edge zones 2 are preferably made of the same material as that of the walking zone, but a different material can be used for the edge zones 2. It is possible that the edge zones 2 can be provided with a rugged face on top and spikes on the bottom.

Figure 2:
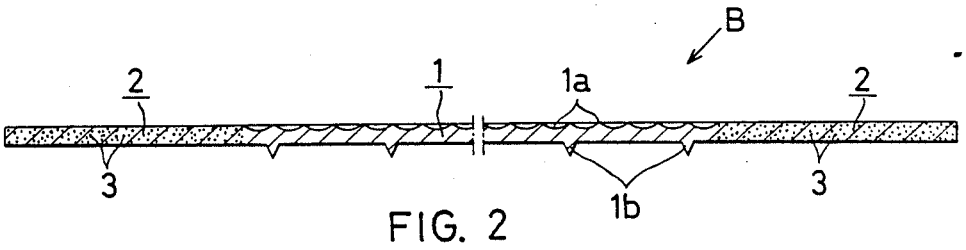
FIG. 2 is a vertical cross-section, partly omitted, through the carpet runner of FIG. 1.

Referring to FIG. 2, the reference numeral 3 denotes a filler intended to increase the weight of the edge zones 2. The filler 3 is made of a substance having a heavier specific gravity than the substance constituting the walking zone 1 and the edge zone 2. Since the edge zones 2 are heavier than the walking zone 1, they can keep contact with the carpet (A). A preferred rate is 1:2 per unit area. For example, when the walking zone 1 and the edge zones 2 are both made of polyvinyl chloride having a specific gravity of 1.2, it is preferred to provide the edge zones 2 with such an amount of filler that the edge zones 2 have a specific gravity of 2.5 or more. The filler 3 is evenly distributed in the edge zones 2.

As the filler 3 calcium carbonate (specific gravity: 2.8), ferrite (specific gravity: 7.0), lead chloride (specific gravity: 9.5), barium sulfate (specific gravity: 4.2), titanium oxide (specific gravity: 4.1) and clay can be used.

Optionally, the walking zone 1 and the edge zones 2 can be made of transparent or semi-transparent plastic so as to see the carpet (A) therethrough. They can also be made of colored plastic so that the runner (B) gives ornamental variation to the carpet.

A method of producing the edge zones 2 is that after materials are respectively prepared for the walking zone 1 and the edge zones 2, they are extruded through an injection nozzle and finished in a calender.

Figure 3:
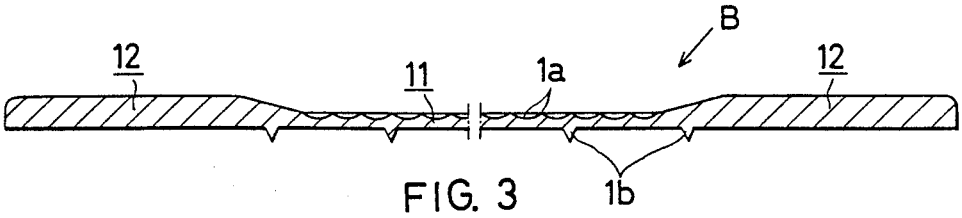
FIGS. 3 to 5 are vertical cross-sectional views, partly omitted, showing three modified versions.

FIG. 3 shows a modified version of the runner (B), characterized in that the edge zones 12 are made to have a greater thickness than the walking zone 11, so that the edge zones 12 can be heavier than the walking zone 11. In this case it is possible to add a plastic having a heavier specific gravity to the base material for the edge zones 12. Alternatively, the edge zones 12 can be made of a heavier plastic than the one of which the walking zone 11 is made.

Figure 4:
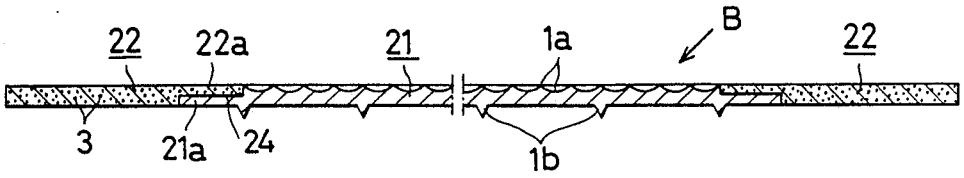

FIG. 4 shows a further modified version of the runner (B), characterized in that the edge zones 22 and the walking zone 21 are made on different processes, and they are fused 24 to each other in shiplap, wherein rebates 21*a* are cut in each edge of the walking zone 21 and rebates 22*a* in the edge zones 22.

Figure 5:
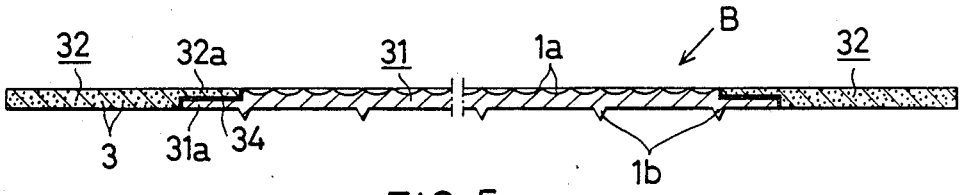
Figure 6:
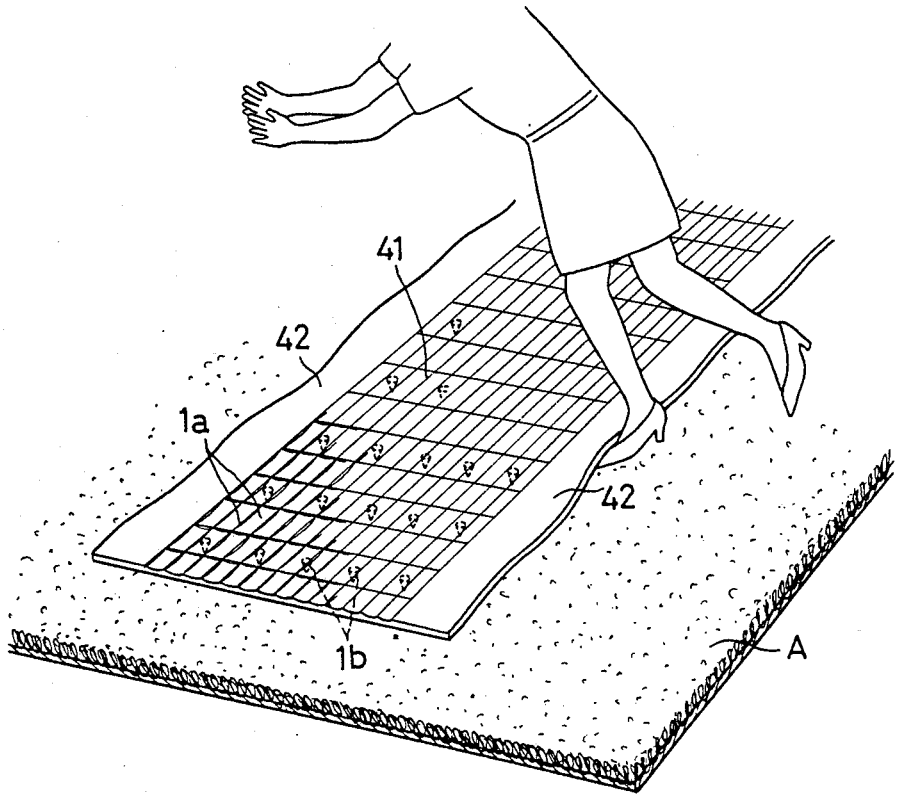
FIG. 6 (Prior Art)
FIG. 6 is a perspective view showing a prior art carpet runner placed on a carpet.

FIG. 5 shows a still further modified version, characterized in that the edge zones 32 are bonded to the walking zone 31 through adhesive layers 34 in shiplaps.

The runner (B) is rolled in a roll, and stored when not in need.

According to the present invention, the edge zones of a carpet runner are heavier than the walking zone, thereby enabling the edge zones to keep contact with the carpet.

What is claimed is:

1. A runner for temporarily covering a carpet to prevent it from becoming soiled, the runner comprising:

a walking zone in the center having a rugged face on the top surface and spikes on the bottom surface; and edge zones at either side of the walking zone, the edge zones being heavier per unit area than the walking zone.

2. A runner as defined in claim 1, wherein the walking zones and the edge zones are made of a soft plastic, and wherein the plastic for the edge zones contain a filler made of a substance having a greater specific gravity than the plastic for the walking zone.

3. A runner as defined in claim 2, wherein the filler is of calcium carbonate, ferrite, lead chloride, barium sulfate, titanium oxide or clay or a combination thereof.

4. A runner as defined in claim 3, wherein the edge zones are made of a substance whose specific gravity is two times heavier than that of the substance for the walking zone.

5. A runner as defined in claim 2, wherein the edge zones are made of a substance whose specific gravity is two times heavier than that of the substance for the walking zone.

6. A runner as defined in claim 1, wherein the edge zones are made of a substance whose specific gravity is two times heavier than that of the substance for the walking zone.

7. A runner as defined in claim 1, wherein the edge zones are thicker than the walking zone.

8. A runner as defined in claim 1, 2, 3, 6, 7, 5, or 4, wherein the walking zone and the edge zones are molded in one piece with a difference in weight between them.

9. A runner as defined in claim 1, 2, 3, 6, 7, 5, or 4, wherein the walking zone and the edge zones are fused to each other.

10. A runner as defined in claim 1, 2, 3, 6, 7, 5, or 4, wherein the walking zone and the edge zones are bonded to each other through adhesive layers.

11. A runner as defined in claim 1, 2, 3, 6, 7, 5, or 4, wherein the walking zone and the edge zones are made of transparent or semi-transparent soft plastic.

* * * * *